US009273508B2

(12) United States Patent
Manaras

(10) Patent No.: US 9,273,508 B2
(45) Date of Patent: Mar. 1, 2016

(54) SENSING MECHANISM FOR AN ASSISTED GARAGE DOOR

(71) Applicant: MICANAN SYSTEMS INC., Dorval (CA)

(72) Inventor: Michel Manaras, Dollard-des-Ormeaux (CA)

(73) Assignee: MICANAN SYSTEMS INC., Dorval, Quebec (CA)

( * ) Notice: Subject to any disclaimer, the term of this patent is extended or adjusted under 35 U.S.C. 154(b) by 0 days.

(21) Appl. No.: 13/861,910

(22) Filed: Apr. 12, 2013

(65) Prior Publication Data

US 2014/0007505 A1 Jan. 9, 2014

Related U.S. Application Data

(63) Continuation of application No. 12/430,615, filed on Apr. 27, 2009, now abandoned.

(60) Provisional application No. 61/071,498, filed on May 1, 2008.

(30) Foreign Application Priority Data

Apr. 25, 2008 (CA) ..... 2629828

(51) Int. Cl.

| | |
|---|---|
| ***E05F 15/70*** | (2015.01) |
| ***E06B 9/15*** | (2006.01) |
| ***E06B 9/70*** | (2006.01) |
| ***E06B 9/88*** | (2006.01) |
| *E06B 9/68* | (2006.01) |

(Continued)

(52) U.S. Cl.

CPC . *E05F 15/70* (2015.01); *E06B 9/15* (2013.01); *E06B 9/70* (2013.01); *E06B 9/88* (2013.01); *E05F 15/41* (2015.01); *E05F 15/684* (2015.01); *E05Y 2900/00* (2013.01); *E05Y 2900/106* (2013.01); *E06B 2009/6818* (2013.01)

(58) Field of Classification Search

USPC ..... 49/26, 28, 197, 199; 160/1, 8, 188; 474/110, 118, 136; 318/445, 450, 466, 318/468

See application file for complete search history.

(56) References Cited

U.S. PATENT DOCUMENTS 4,438,903 A * 3/1984 Gagnon et al. ..... 254/269
6,070,641 A * 6/2000 Budetti ..... 160/302

(Continued)

OTHER PUBLICATIONS

Final Office Action mailed on Oct. 12, 2012 in U.S. Appl. No. 12/430,615. (9 pages).

(Continued)

*Primary Examiner* — Katherine Mitchell
*Assistant Examiner* — Catherine A Kelly
(74) *Attorney, Agent, or Firm* — Novak Druce Connolly Bove + Quigg LLP

(57) ABSTRACT

A garage door opening module is disclosed, the module comprises a power unit having a rotatable output drive, an endless transmission drive adapted to transfer movement from the rotatable output drive to a door drive, and a sensor mechanism positioned along the endless transmission drive and adapted to sense a transmission drive slack, the sensor mechanism adapted to stop the power unit when a transmission drive slack displacement threshold is reached. A method for actuating a garage door and a sensor module for preventing movements of an assisted garage door are also disclosed.

20 Claims, 19 Drawing Sheets

(51) Int. Cl.
*E05F 15/41* (2015.01)
*E05F 15/684* (2015.01)

(56) References Cited

U.S. PATENT DOCUMENTS 6,092,582 A 7/2000 Liu
6,485,068 B1 * 11/2002 Sauve ..... 292/171
6,782,662 B2 * 8/2004 McCartney et al. ..... 49/197
7,222,839 B2 * 5/2007 Taylor et al. ..... 254/270
2005/0187053 A1 8/2005 Kim
2008/0127560 A1 * 6/2008 Harvey ..... 49/199

OTHER PUBLICATIONS

Non final Office Action mailed on Dec. 21, 2011 in U.S. Appl. No. 12/430,615. (8 pages).

* cited by examiner

SENSING MECHANISM FOR AN ASSISTED GARAGE DOOR

CROSS-REFERENCE TO RELATED APPLICATIONS

This application is a Continuation of U.S. patent application Ser. No. 12/430,615, filed on Apr. 27, 2009, which claims priority to Canadian Patent Application No. 2,629,828 filed on Apr. 25, 2008 and to U.S. Provisional Patent Application No. 61/071,498 filed on May 1, 2008, the entirety of both of these applications being herein incorporated by reference.

FIELD OF THE INVENTION

The present invention relates to an assisted garage door closure mechanism. More precisely the present invention relates to a mechanism for sensing the force applied by the power unit of the assisted garage door closure mechanism.

BACKGROUND OF THE INVENTION

Assisted garage door opening mechanisms are used to automatically open a garage door without human intervention. They help to assist opening/closing garage doors or simply allow remote actuation of a garage door (e.g. from inside the car with a wireless transmitter).

The assisted garage door opening mechanism is commonly installed inside the garage and is mechanically connected to the garage door to alternatively move the garage door up and down.

A locking mechanism is usually installed on the garage door to manually lock the garage door in a closed position and secure the goods stored in the garage. The locking mechanism can be a simple steel rod secured to the garage door and selectively engaging an associated opening in a garage doorframe thus preventing the garage door from opening.

The locking mechanism, when engaged, prevents people outside the garage to open the door but also prevents the assisted garage door opening mechanism to open the garage door. The assisted garage door opening mechanism will force against the locking mechanism if the assisted garage door opening mechanism is activated when the garage door is locked. This happens because the assisted garage door opening mechanism cannot make the difference between a locked and unlocked garage door.

Known assisted garage door opening mechanisms can be equipped with end-of-travel sensors. An end-of-travel sensor senses when the garage door reaches its opened position and another end-of-travel sensor senses when the garage door reaches its closed position. The opened position end-of-travel sensor sends a signal to the assisted garage door opening mechanism to stop opening the garage door. In contrast, the closed position end-of-travel sensor sends a signal to the assisted garage door opening mechanism to stop closing the garage door. In both situations the movement of the garage door is stopped because it has reached its desired position. Unfortunately, these end-of-travel sensors are not helpful in preventing the assisted garage door opening mechanism to try to open a locked garage door because the garage door is already in its closed position. The closed position end-of-travel sensor being already activated and the open position end-of-travel sensor being not activated the assisted garage door opening mechanism infers it can move the garage door upward despite the garage door might be locked.

Therefore, a need has been found for an improved garage door opening mechanism. Similarly, a need has arisen for an improved garage door opening mechanism that will not enable to move a locked garage door or a garage door that is blocked. There is also a need for a retrofit module that can be added to a garage door opening mechanism to prevent the garage door to open a locked garage door.

SUMMARY OF THE INVENTION

An aspect of the present invention provides a novel garage door opening mechanism.

Another aspect of the present invention provides a garage door opening mechanism having a transmission drive sensing capability to determine the amount of force applied to a garage door by the garage door opening mechanism.

One other aspect of the present invention provides a force sensing module, or kit, adapted to be added to an existing assisted garage door opening mechanism to enable determining the amount of force applied to a garage door by the garage door opening mechanism.

An aspect of the present invention provides a method for determining the amount of force applied on a closed garage door by an assisted garage door opening mechanism and preventing the assisted garage door opening mechanism to open the garage door when the amount of force applied on the garage door exceeds a predetermined threshold.

Another aspect of the present invention provides a method for sensing the amount of slack in a transmission member to determine the amount of force transmitted to the garage door and prevents the garage door from being opened if the amount of slack in the transmission member exceeds a predetermined slack threshold.

Therefore, in accordance with the present invention, there is provided a garage door opening module comprising: a power unit having a rotatable output drive, the power unit being adapted to move the garage door when the power unit is used in conjunction with the garage door; an endless transmission drive adapted to transfer movement from the rotatable output drive to a door drive; and a sensor mechanism positioned along the endless transmission drive and adapted to sense a transmission drive slack, the sensor mechanism adapted to stop a movement of the door drive when a transmission drive slack displacement threshold is reached.

Also in accordance with the present invention, there is provided a method for actuating a garage door, the method comprising: powering a power unit adapted to open and close a garage door; sensing a slack in an endless transmission drive transmitting movement between the power unit and the garage door; and sending a signal adapted to stop moving the garage door when the slack in the transmission drive is less than a predetermined slack threshold.

Further in accordance with the present invention, there is provided a sensor module for preventing movements of an assisted garage door, the sensor module comprising: a sensor adapted to be in electrical communication with a power unit; a support bracket adapted to position the sensor about an endless transmission drive transmitting movement from the power unit to the garage door; and a contacting member adapted to contact the endless transmission drive, the sensor being adapted to prevent an assisted movement of the garage door when the sensor reaches a predetermined endless transmission drive slack threshold.

Throughout the present specification the following terms are generally used with their following associated meaning:

1. Slack: Stroke, looseness or play in an endless transmission drive, like a chain or a belt for example, measured between two sprockets or sheaves. The amplitude of the stroke is determined by moving the endless transmission drive, at some place between the sprockets or sheaves, orthogonally in respect of a tangent line between the two sprockets. The amplitude is defined by a length.

2. Sensor: A device that responds to a physical stimulus and transmits a resulting impulse or a resulting change of state. Could be normally opened or normally closed depending on the specific purpose and the installation of the sensor.
3. Threshold: A level at which the sensor begins to send an impulse or changes of state. The threshold can be selected and adjusted according to a desired physical arrangement.

Embodiments of the present invention do not necessarily have all of the above-mentioned objects and/or aspects.

Additional and/or alternative features, aspects, and advantages of the embodiments of the present invention will become apparent from the following description, the accompanying drawings, and the appended claims.

BRIEF DESCRIPTION OF THE DRAWINGS

The features of the invention will become more apparent in the following detailed description in which reference is made to the appended drawings, wherein.

DESCRIPTION OF ILLUSTRATIVE EMBODIMENTS OF THE INVENTION

The preferred embodiment illustrated in the Figures is one possible mechanical arrangement among other workable variations. These other workable variations are not considered to be enough materially distinctive so that a person skilled in the art of assisted garage door would not know how to adapt the present invention thereto.

Figure 1:
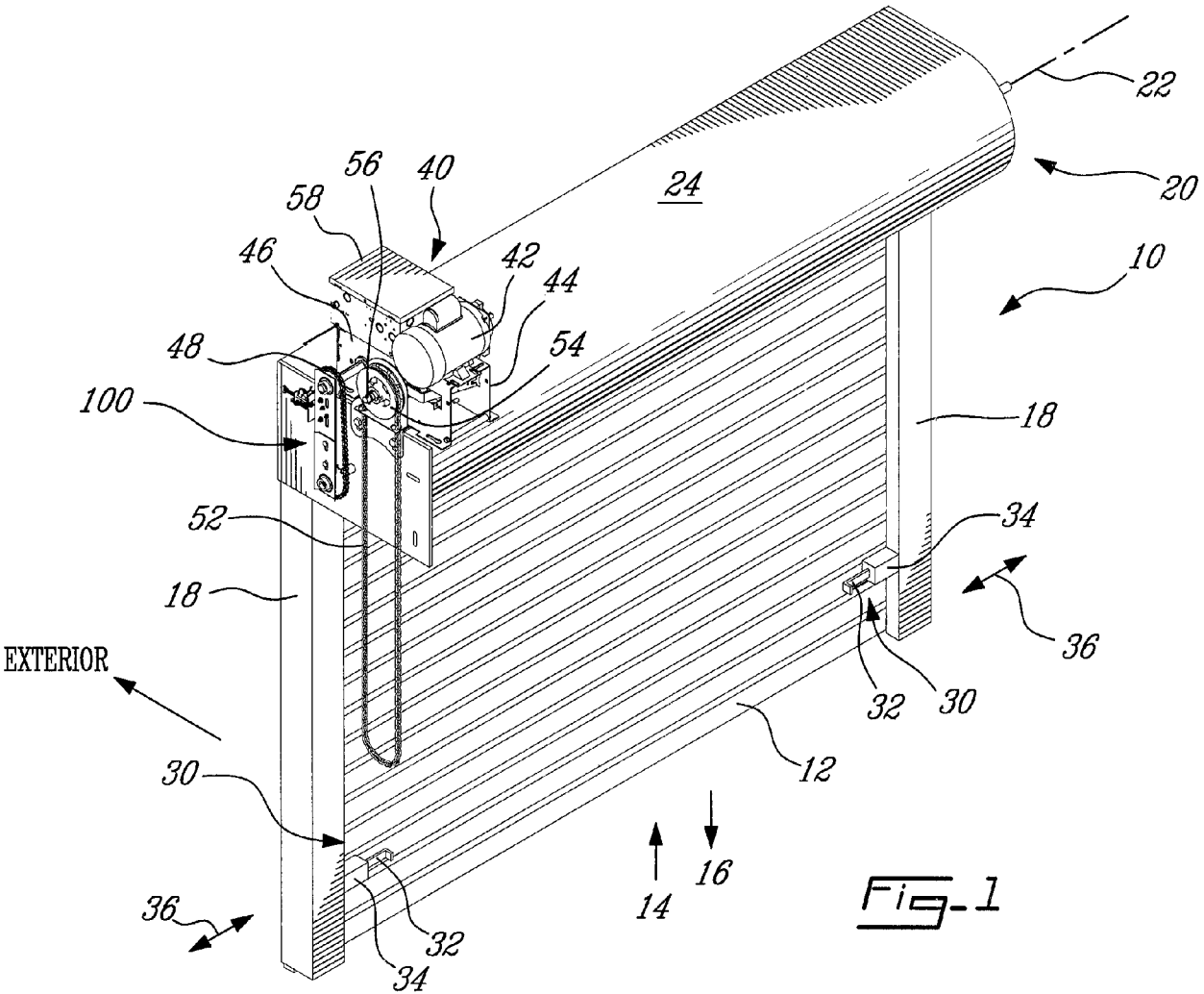
FIG. 1 is a perspective view of a first embodiment of a garage door with an assisted garage door opening mechanism in a non-actuated state.

FIG. 1 illustrates a garage door assembly 10 with a garage door 12 adapted for moving up 14 and down 16 along side guides 18. The illustrated garage door 12 is designed such that it rolls in an overhead space 20 about roll axis 22 to reduce the space taken by the garage door 12 when the garage door 12 is open. A garage door protector 24 prevents dirt and foreign objects to interfere with the rolled garage door 12. Other ways of storing an opened garage door are well known in the art and will not be described in the instant patent application given their limited influence on the present invention.

A manual locking mechanism 30 can be appreciated on FIG. 1. A rod 32 (or a deadbolt) is slidably maintained to the garage door 12 by a fixed member 34 connected to the garage door 12. The rod 32 is adapted to engage a corresponding opening (not visible on FIG. 1) provided in the side guide 18. A lateral actuation 36 selectively engages and disengages the rod 32 to/from the side guide 18 to prevent opening of the garage door 12 and allow opening of the garage door 12, respectively. Two manual locking mechanisms 30 are displayed on the garage door 12 to ensure both sides of the garage door 12 are secured to their associated side guides 18.

Still on FIG. 1, a garage door opening mechanism 40 is illustrated. The garage door opening mechanism 40 is installed next to the garage door 12 and assists opening of the garage door 12. The illustrated garage door mechanism 40 is disposed on one side of the garage door 12 but could perfectly be located anywhere next to the garage door 12 as long as the garage door opening mechanism 40 can be operatively connected to the garage door 12 without departing from the scope of the present invention. The garage door opening mechanism 40 could perfectly be located on the opposite side of the garage door protector 24 as it will be described later.

The disclosed embodiment depicts a garage door opening mechanism 40 cooperating with a "roll-up" type garage door 12 (i.e. the opened garage door is stored in a roll shape). The garage door opening mechanism 40 used to enable movement to the garage door 12 can be operatively installed to a different type of garage door 12 (e.g. sectional garage door or fabric garage door) and still remain within the scope of the present invention.

A power unit 42 is fastened on a power unit support 44 that is affixed to the garage door protector 24. The power unit 42 of the illustrated embodiment is an electric motor that preferably works on domestic or industrial power supply (e.g. AC~120, 220 or 550 Volts). The power unit 42 has a rotatable power output member (not visible on FIG. 1) that transfers rotatative movement from the power unit 42 to a gearbox 46. The gearbox 46 changes the ratio of the final output drive 48 (e.g. the number of rotation-per-minute, or RPM) before it is operatively connected to the garage door 12 to actuate the garage door 12. Other types of mechanical drives, including other types of gear or belt mechanisms, suitable to change the output ratio of the power unit 42, or not, could be used without affecting the principles of the present invention.

Rotational speed reduction of the power unit 42 proportionally increases the torque produced by the power unit 42. The increased torque allows opening a significantly heavy garage door 12 with a power unit 42 of relative small size while reducing the speed of the garage door 12 movement.

Figure 2:
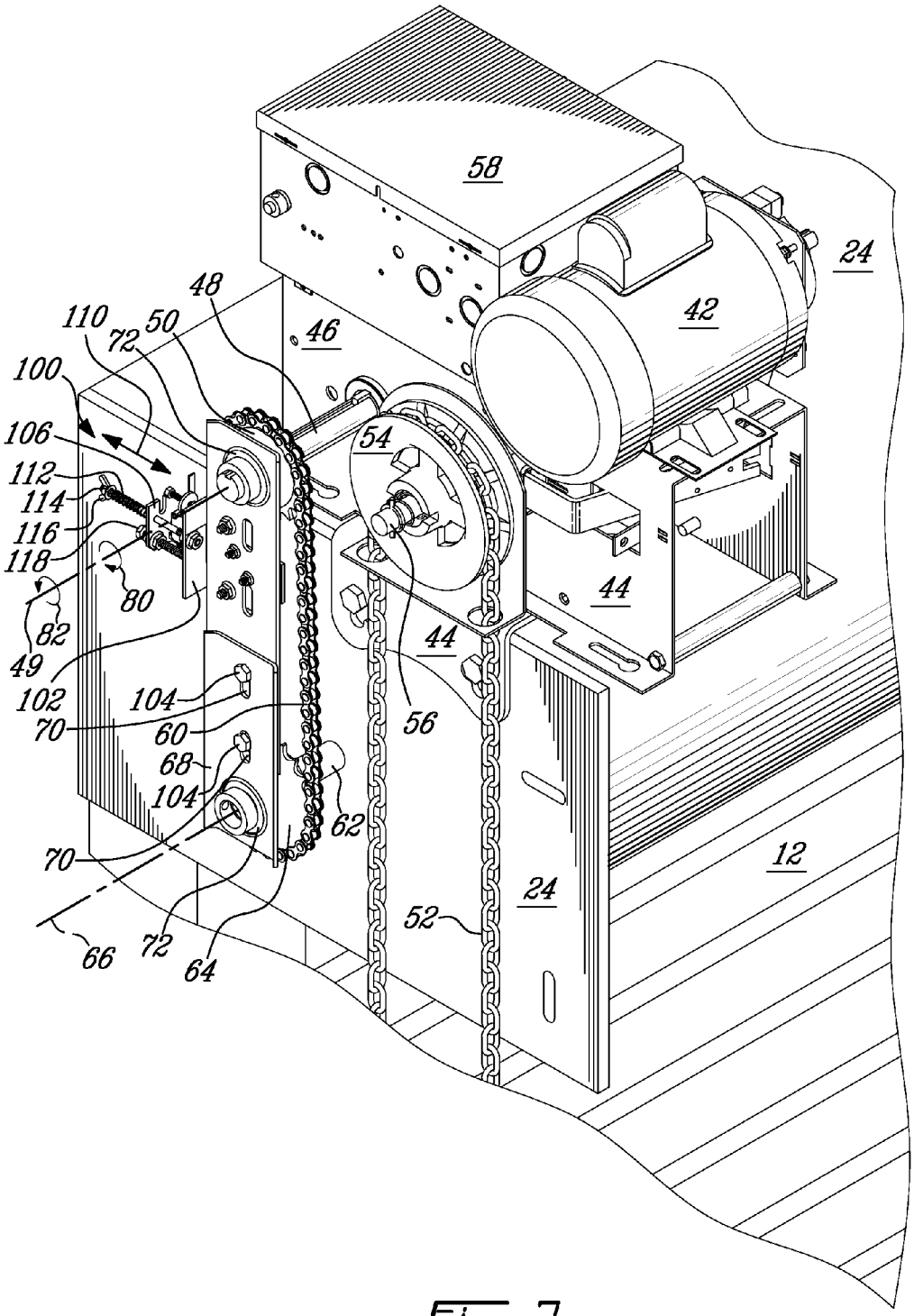
FIG. 2 is a magnified perspective view of the assisted garage door opening mechanism of FIG. 1.
Figure 3:
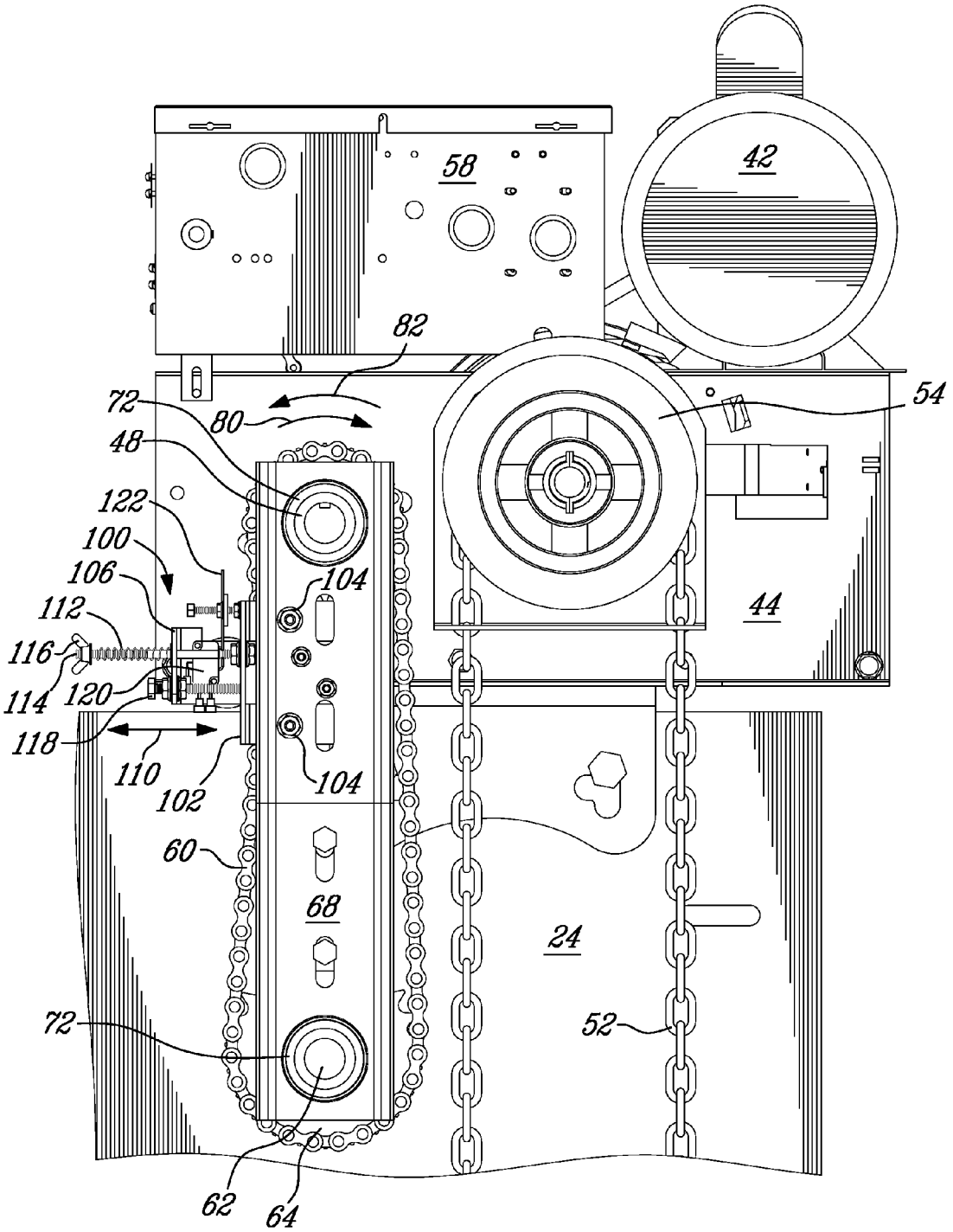
FIG. 3 is an elevational view taken from the left side of the assisted garage door mechanism of FIG. 1.
Figure 4:
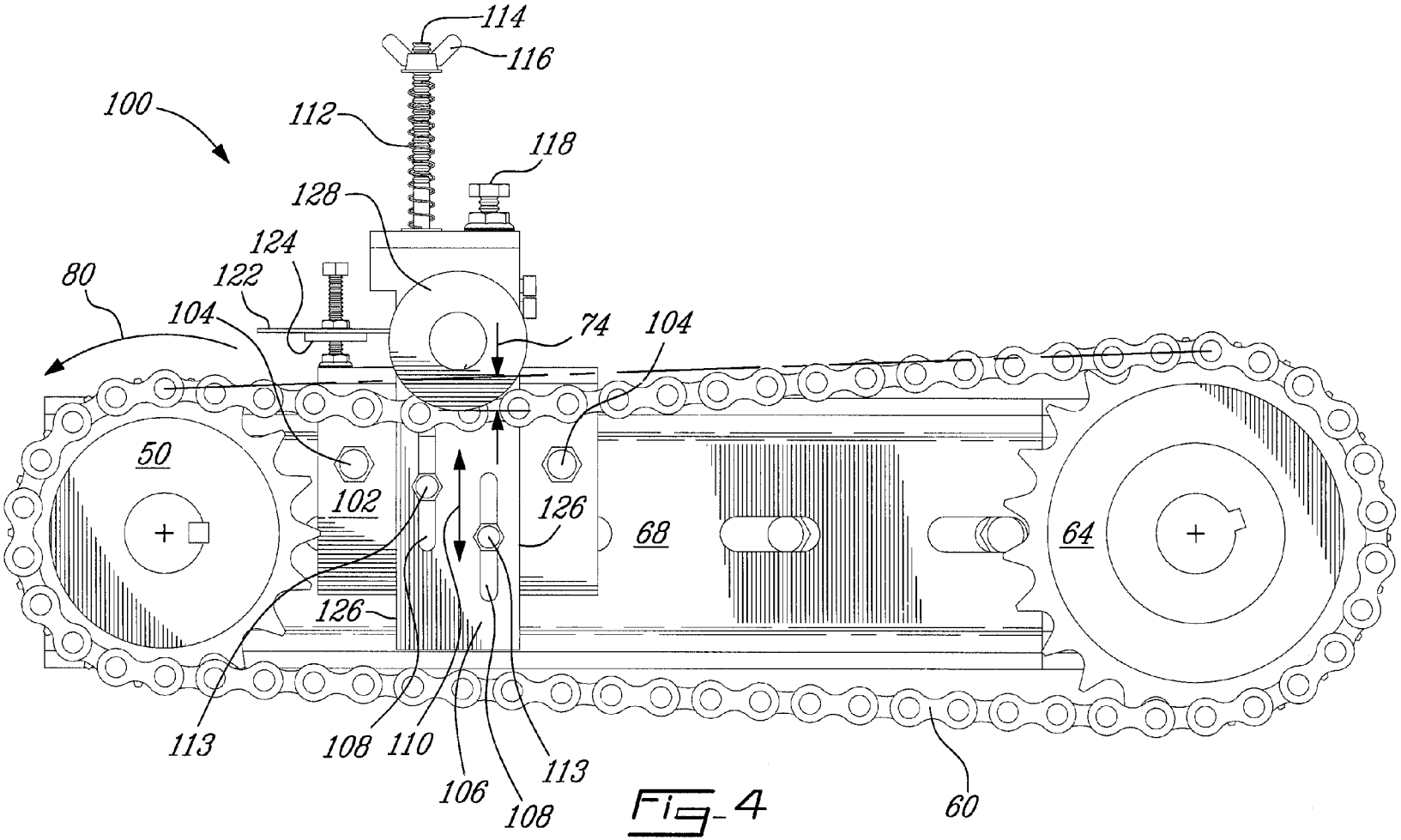
FIG. 4 is an elevational view taken from the right side of the isolated assisted garage door mechanism of FIG. 1.
Figure 5:
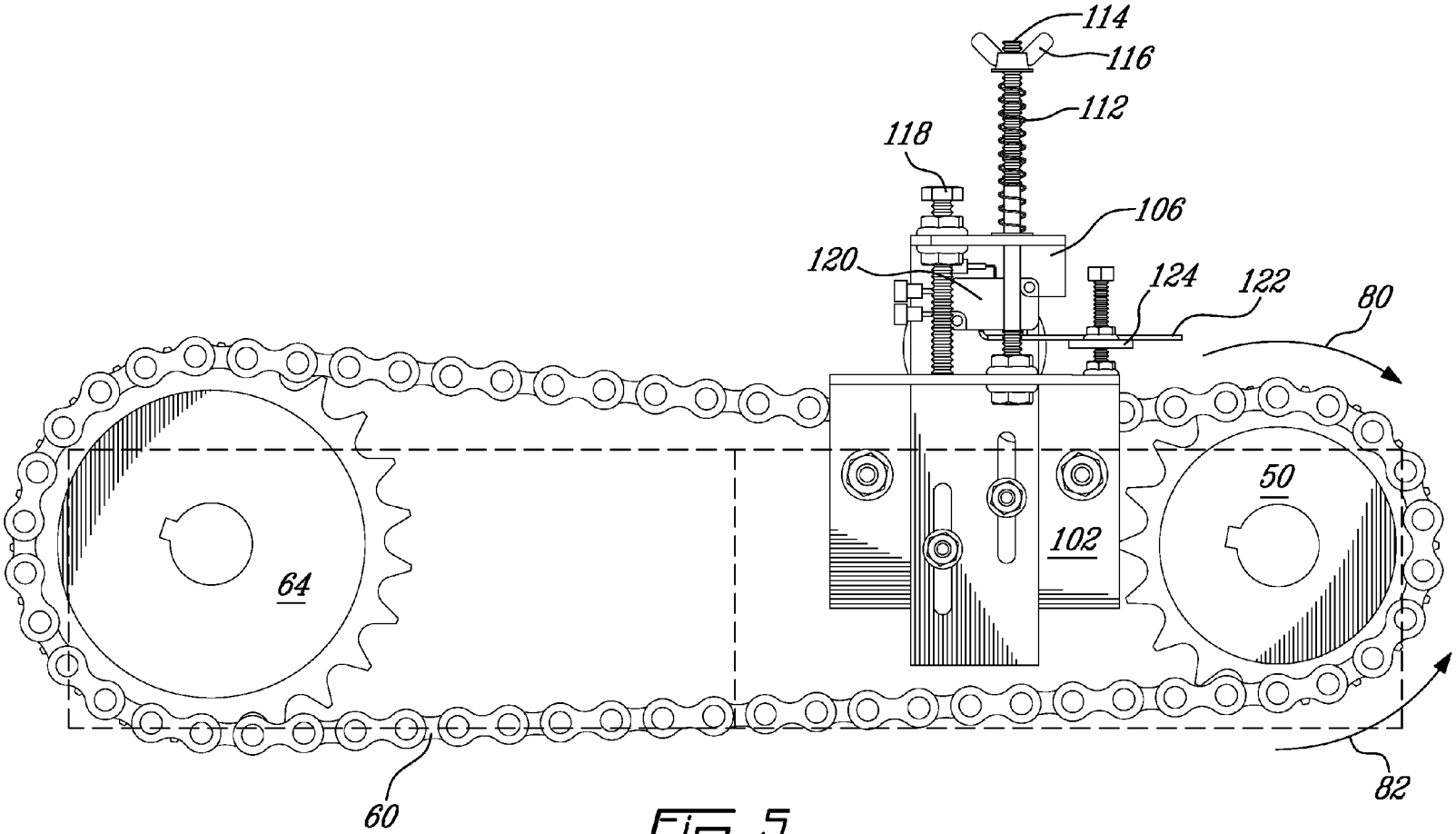
FIG. 5 is an elevational view taken from the left side of the isolated assisted garage door mechanism of FIG. 1.
Figure 6:
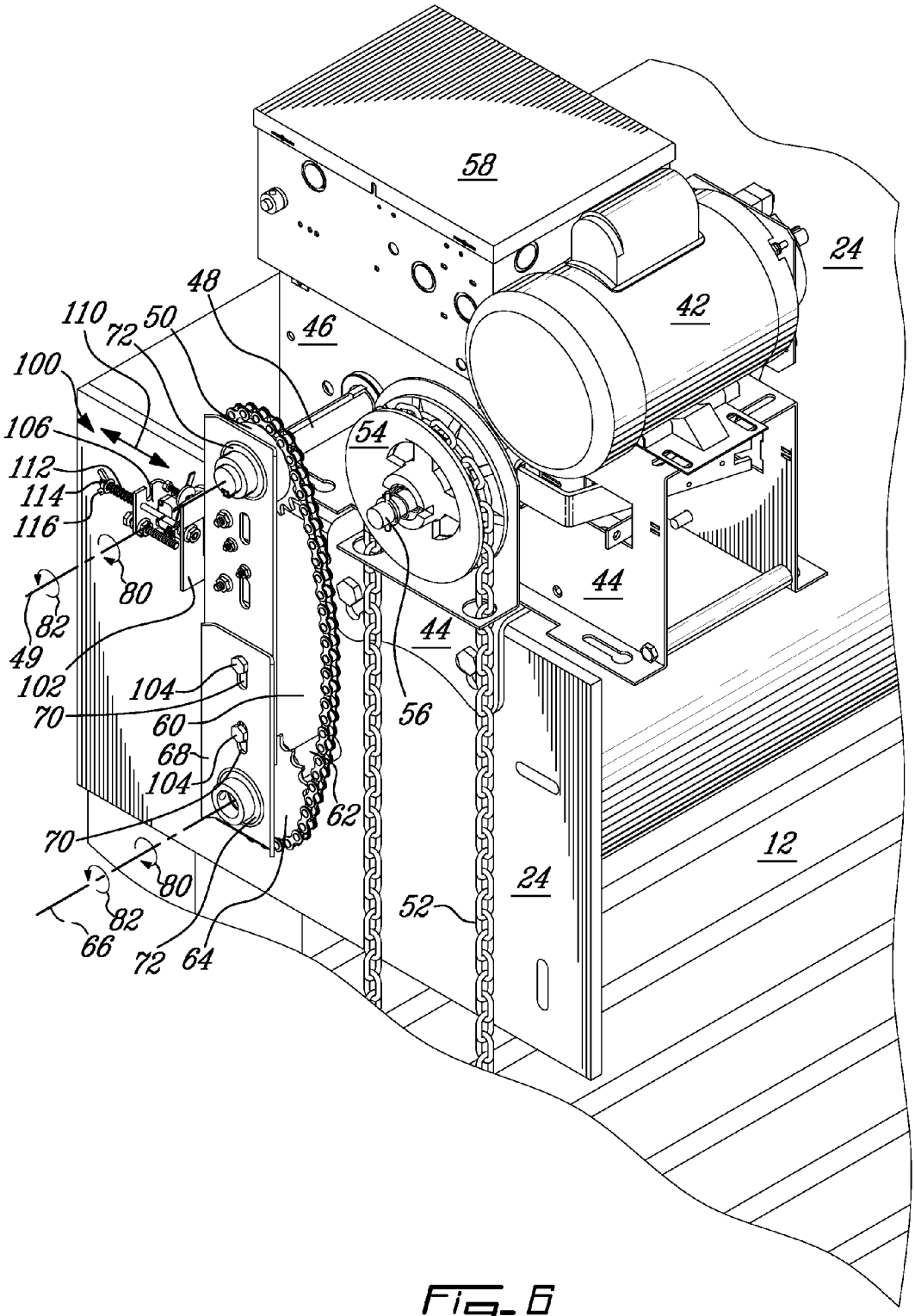
FIG. 6 is a perspective view of the garage door of FIG. 1 with the assisted garage door opening mechanism in an actuated state.
Figure 7:
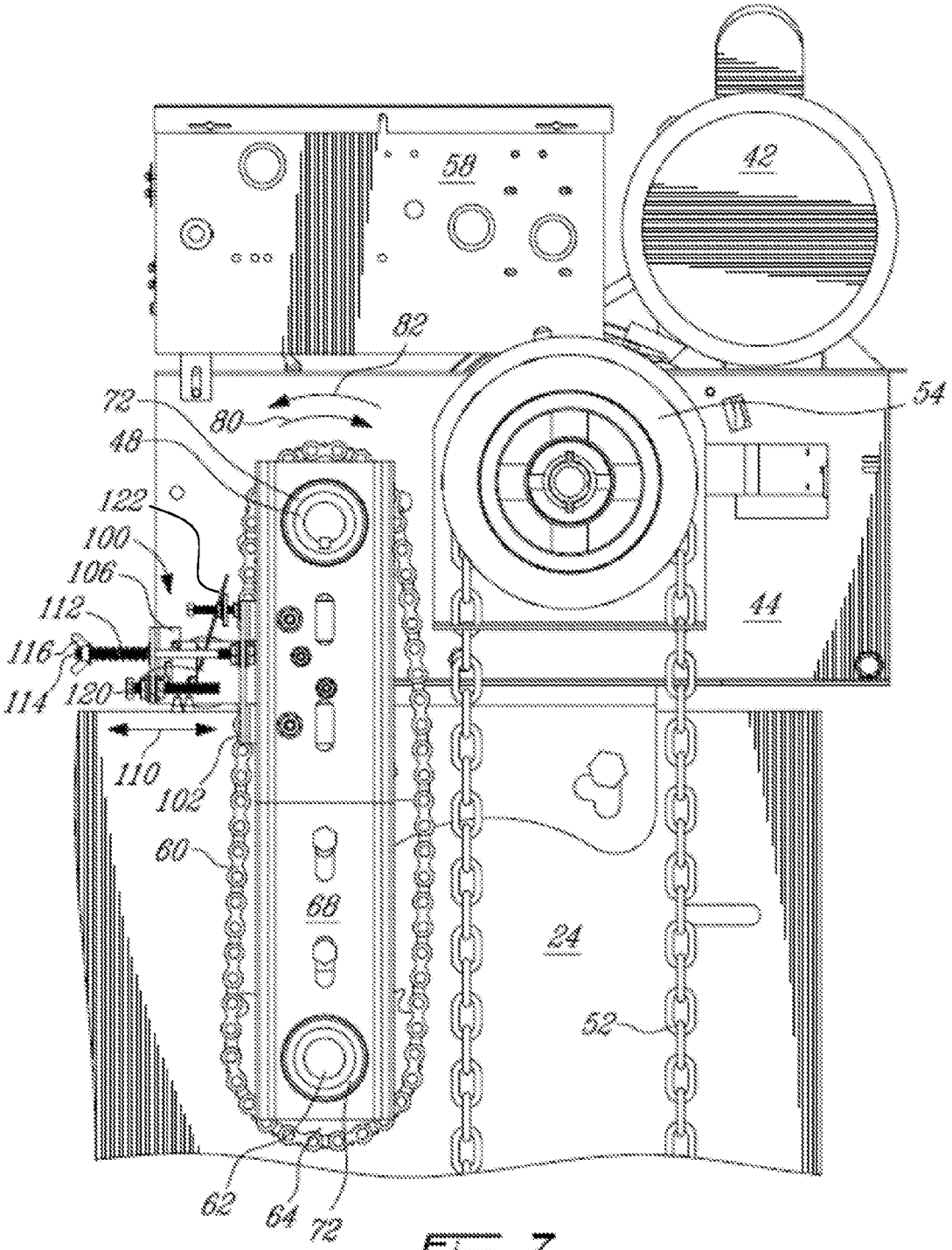
FIG. 7 is a magnified perspective view of the assisted garage door opening mechanism of FIG. 6.
Figure 8:
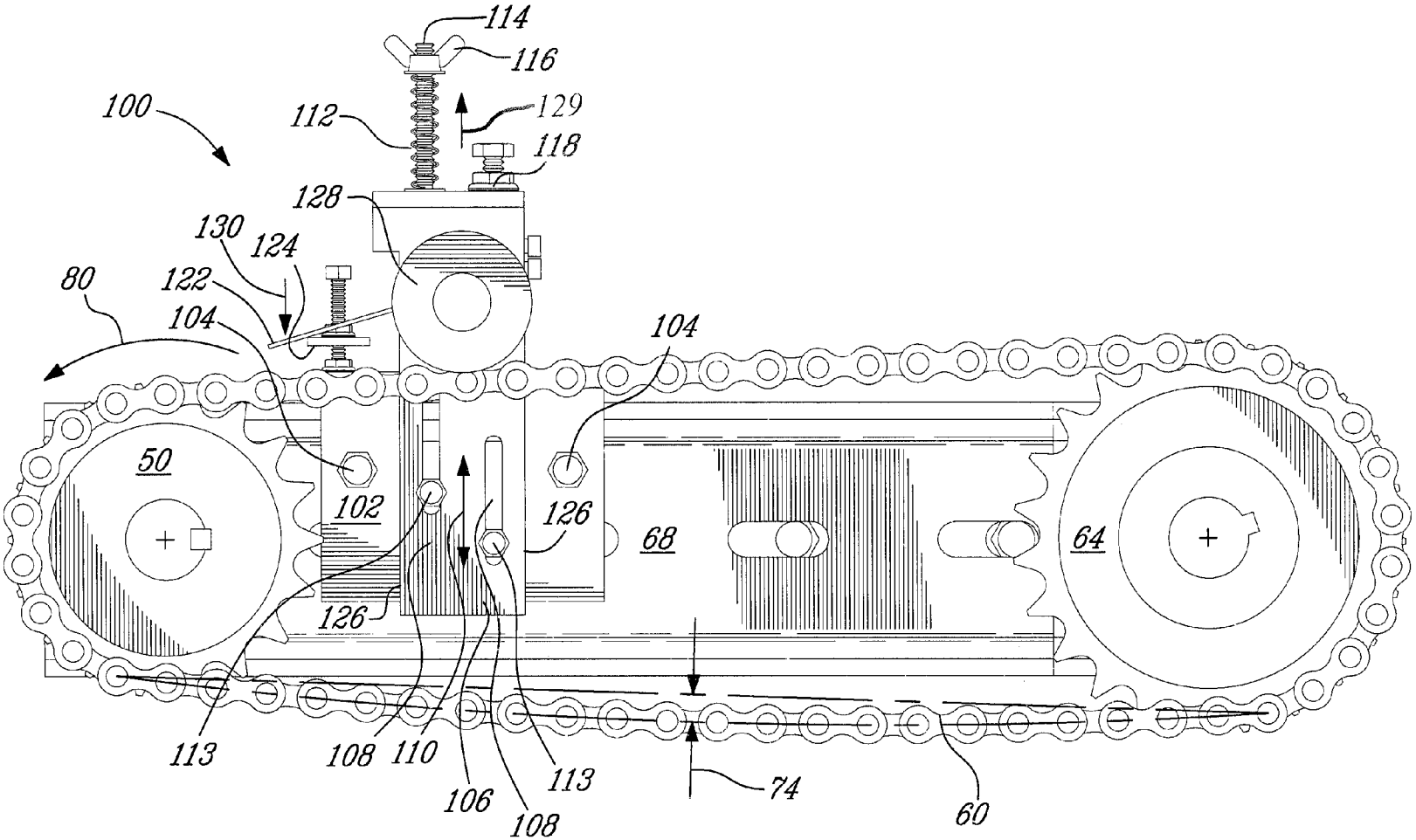
FIG. 8 is an elevational view taken from the right side of the assisted garage door mechanism of FIG. 6.
Figure 9:
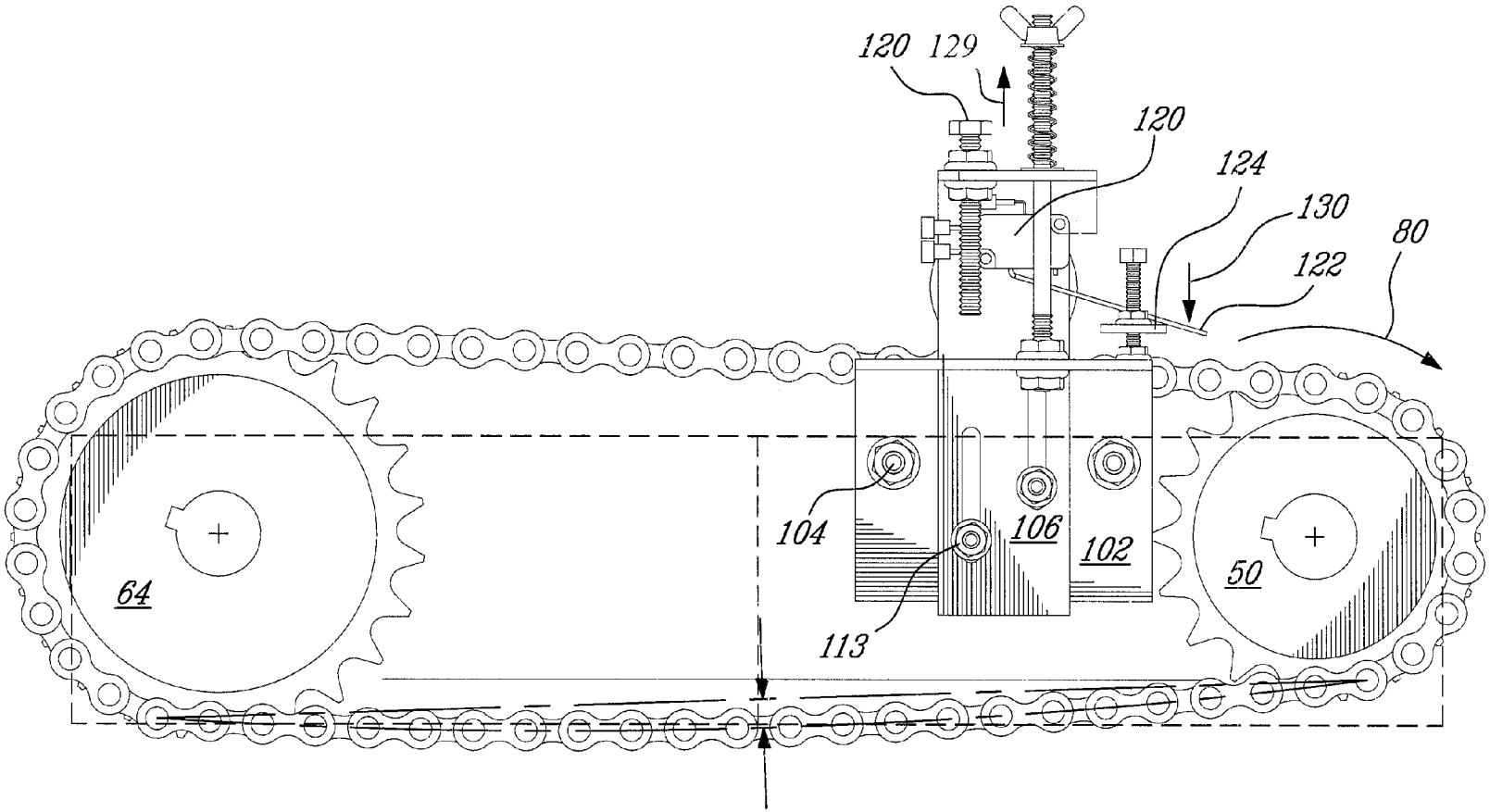
FIG. 9 is an elevational view taken from the left side of the isolated assisted garage door mechanism of FIG. 6.

As best seen on FIG. 2, that is a magnified view of a portion of FIG. 1, the final output drive 48 illustrated in the present invention uses a sprocket 50 adapted to interact with an endless transmission drive 60 to transfer movement to the garage door 12. In the present embodiment the endless transmission drive 60 is illustratively a chain drive. A person skilled in the art would understand a belt drive (not shown in the Figures but some examples can be found on http://en.wikipedia.org/wiki/Belt_(mechanical)) could be used to transfer movement from the final output drive 48 to the garage door 12 via door drive 62. An electric box 58 is also depicted on FIG. 2. The electric box 58 provides a secured volume for connecting the electric wires to power the power unit 42.

A secondary chain 52, or chain hoist, is operatively connected to a secondary sprocket 54 to manually actuate the garage door 12. The manual actuation of the garage door 12 can overrule the movement that should be enabled by the power unit 42 to manually open the garage door 12 when, for example, there is a grid power failure. The secondary chain 52, when manually pulled down in one direction, rotates the secondary sprocket 54 about the secondary axis 56. The secondary axis 56 transfers the rotational movement to the gearbox 46 to move the garage door 12 via rotation of the final output drive 48.

The endless transmission drive 60 interconnects the final output drive 48 to the door drive 62 with intervening sprockets 50, 64, rotating about their respective axes 49, 66. The sprockets 50, 64, can be of different sizes to provide further ratio adjustment in addition to the gearbox 46. A support plate 68 is interconnecting the cantilever end of the final output drive 48 with the cantilever end of the door drive 62 to increase rigidity of the assembly. Intervening bearings 72 are provided to both the final output drive 48 and the door drive 62 to rotate about the support plate 68. Adjustment slots 70 are provided to change the length of the support plate 68 and adapt the support plate 68 to a different axes 49, 66 layout. The length of the support plate 68 is secured by fasteners 104.

Direct Sensor Mechanism—Door Moving Upward

FIGS. 1 through 9 illustrate a sensor mechanism 100 directly disposed on the endless transmission drive 60 and secured to the garage door assembly 10. FIGS. 1 through 5 depict the direct sensor mechanism 100 in a non actuated state while FIGS. 6 through 9 depict the direct sensor mechanism 100 in an actuated state. The latter case will be discussed later in the specification.

The direct sensor mechanism 100 is used to determine the amount of slack 74 (best seen on FIG. 4) in the endless transmission drive 60 to infer the resistance provided by the garage door 12 when the power unit 42 applies motion to the garage door 12. The tension in the endless transmission drive 60 will not be significant enough to actuate the direct sensor mechanism 100 if motion is applied by the power unit 42 and the garage door 12 is free to move up. In contrast, if the garage door is manually locked with the locking mechanism 30, the garage door 12 cannot move up under the action of the power unit 42 and this will enable an increased tension in the endless transmission drive 42 that will actuate the direct sensor mechanism 100.

As best seen on FIGS. 2 through 5, the direct sensor mechanism 100 is illustratively fastened to the support plate 68 via a direct sensor fixed bracket 102. The direct sensor fixed bracket 102 is fastened to the support plate 68 with a series of fasteners 104. Alternatively, the direct sensor fixed bracket 102 could be connected to the garage door protector 24 or connected to any structure suitable to maintain it adequately in cooperation with the endless transmission drive 60. Further, referring now more specifically to FIG. 4, the direct sensor mechanism 100 comprises a sensor frame 106 slidably mounted to the support plate 68 and/or to the direct support fixed bracket 102. The slidable capability 110 is provided by slots 108 allowing movements about some fasteners 113 acting as guides. This slidable capability 110 of the sensor frame 106 allows the bearing member 128 to move in conjunction with the endless transmission drive 60 slack 74. The shape of the direct sensor fixed bracket 102 provides additional guides 126 ensuring proper linear movement of the sensor frame 106 in respect to the parts that remain fixed. The sensor frame 106 is biased toward the endless transmission drive 60 and follows the endless transmission drive 60 notwithstanding the amount of slack 74 in the endless transmission drive 60. It is understood that the sensor frame 106 has a limited stroke about the fixed bracket 102 but that stroke is proportional to the normally expected range of slack 74 in the endless transmission drive 60.

The bearing member 128 depicted in this embodiment is a circular bearing member that is adapted to rotate with the motion (i.e. linear displacement) of the endless transmission drive 60. A non-rotatable bearing member 128 made of low friction material (e.g. Teflon™) could perform a similar function and is also encompassed by the instant application.

The sensor frame 106 is biased toward the endless transmission drive 60 with a spring 112 that is guided by a guide member 114 fixedly fastened to the direct sensor fixed bracket 102. The preload provided by the spring 112 to the sensor frame 106 applies pressure on the endless transmission drive 60 through the bearing member 128. The bearing member 128 provides minimum tension in the endless transmission drive 60 while recuperating the slack 74 in the endless transmission drive 60. The tension provided by the spring 112 can be adjusted by preloading the spring 112 by turning the nut 116. Increasing the spring 112 preload proportionally increases the amount of force needed to activate the direct sensor mechanism 100. One practical effect of increasing the preload is to adjust the sensor 120 threshold to a heavier garage door 12 or a garage door 12 that is simply harder to open.

The movement of the sensor frame 106 is limited by an adjustable stopper 118 connected thereto and abutting the direct sensor fixed bracket 102 at the end of the sensor frame 106 permitted travel. A sensor 120 is connected to the sensor frame 106 and is actuated by a sensor lever 122 contacting the direct sensor fixed bracket 102. The exact level at which the sensor 120 will react can be tuned by changing the position of the lever contact member 124 that optionally intervenes between the direct sensor fixed bracket 102 and the sensor lever 122.

The final output drive 48 rotates in two directions. A first direction, as indicated by arrow 80, moves the garage door 12 upward, conversely, rotation of the final output drive in the opposite direction, indicated by arrow 82, moves the garage door 12 downward. The direct sensor mechanism 100 is contacting the transmission drive 60 segment (i.e. the portion of transmission drive 60 between two sprockets 50, 64) that is tensioned when the garage door 12 is moved upward. In the event the garage door 12 is locked with the locking mechanism 30 the garage door opening mechanism 40 is going to apply significantly more tension in the endless transmission drive 60 then it normally has to. The direct sensor mechanism 100, that is building a predetermined amount of tension on the endless transmission drive 60, is positioned by the slack 74 in the endless transmission drive 60. Referring now to FIGS. 6 through 9, when the tension increases in the endless transmission drive 60, because the garage door 12 cannot move upward as easily as it is supposed to normally do, the sensor frame 106 is pushed by the endless transmission drive 60 and the sensor 102 is activated if the stroke 129 is significant enough to move beyond the sensor 102 threshold. In the present situation the switch lever 122 is moved down 130 with the stroke 129.

When the sensor 102 threshold is reached the sensor 102 cuts the power input of the power unit 42 in the case the sensor 102 is used on the power electrical circuit. Conversely, the sensor 102 sends a signal or cut the control circuit, thus providing a signal, if the sensor 102 is applied to a control electrical circuit. The control electrical circuit will act on the power electrical circuit and stop the power unit 42. In both situations the power unit 42 will not open the garage door 12.

Optionally, the direct sensor mechanism 100 could be used with a clutch (not shown) or another kind of power dissipation means adapted to prevent movement of the garage door 12.

Lever Sensor Mechanism—Door Moving Upward

Figure 10:
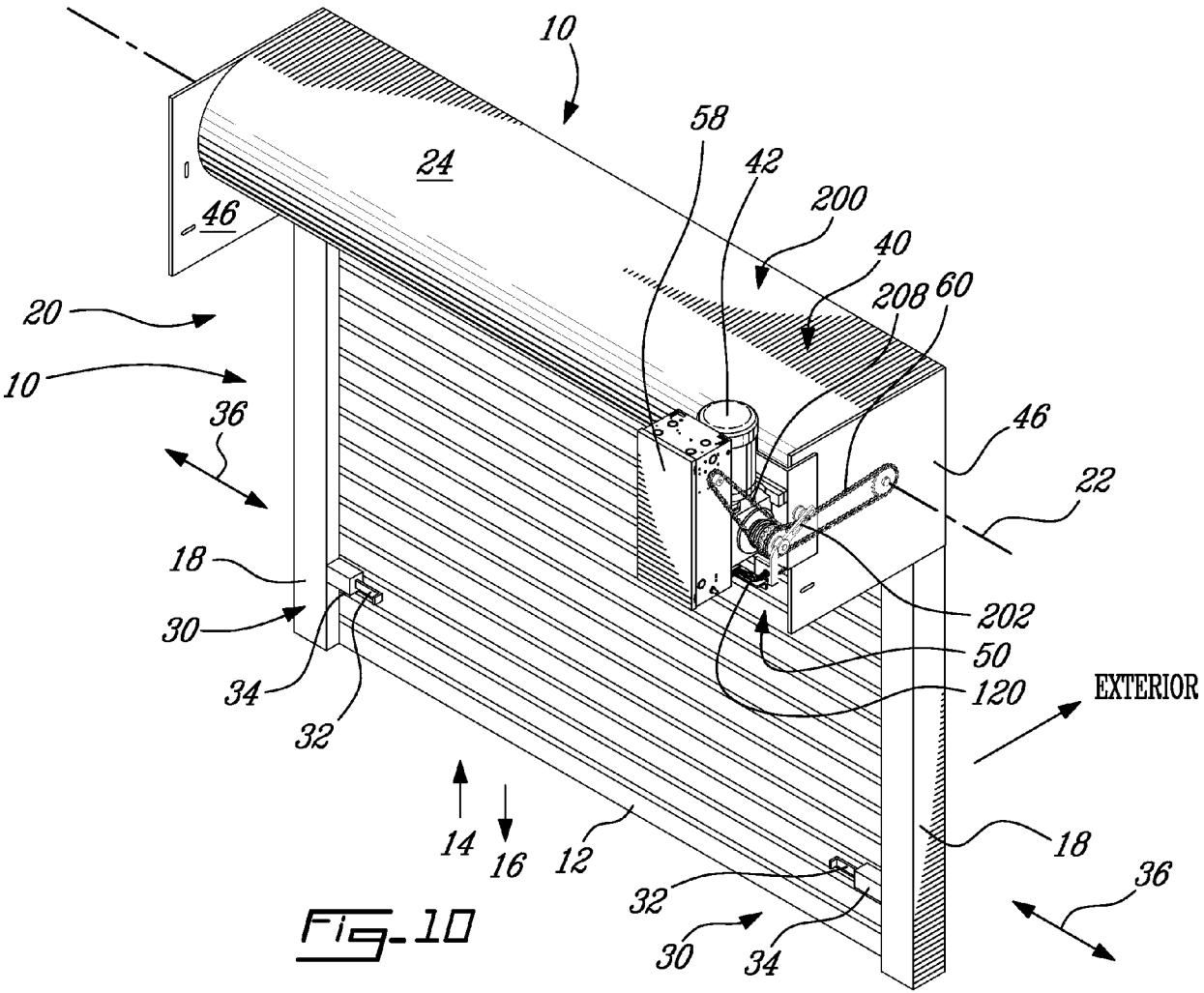
FIG. 10 is a perspective view of a second embodiment of a garage door with an assisted garage door opening mechanism in a non-actuated state.
Figure 11:
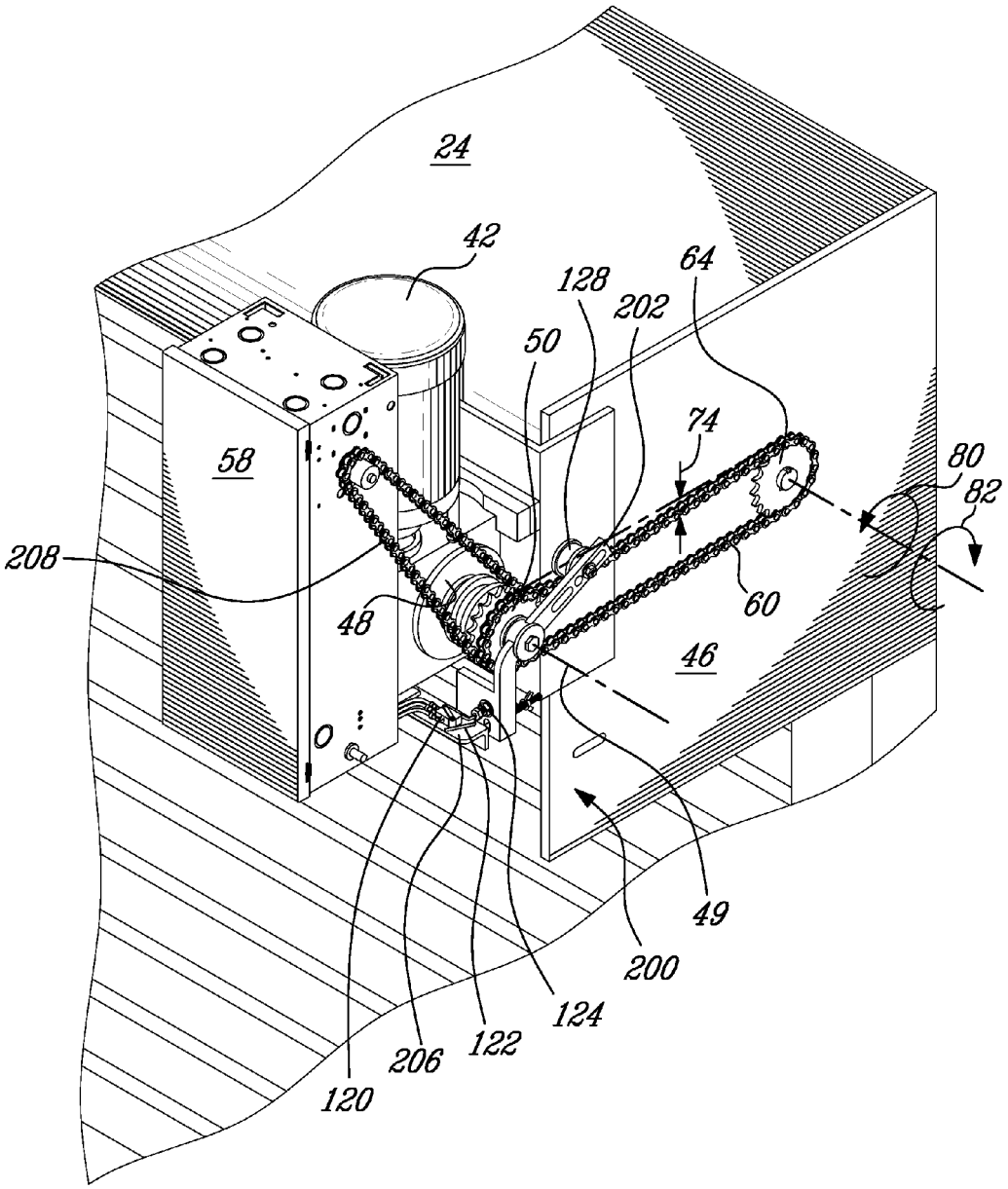
FIG. 11 is an elevational view taken from the right side of the isolated assisted garage door mechanism of FIG. 10 in a non actuated state.
Figure 12:
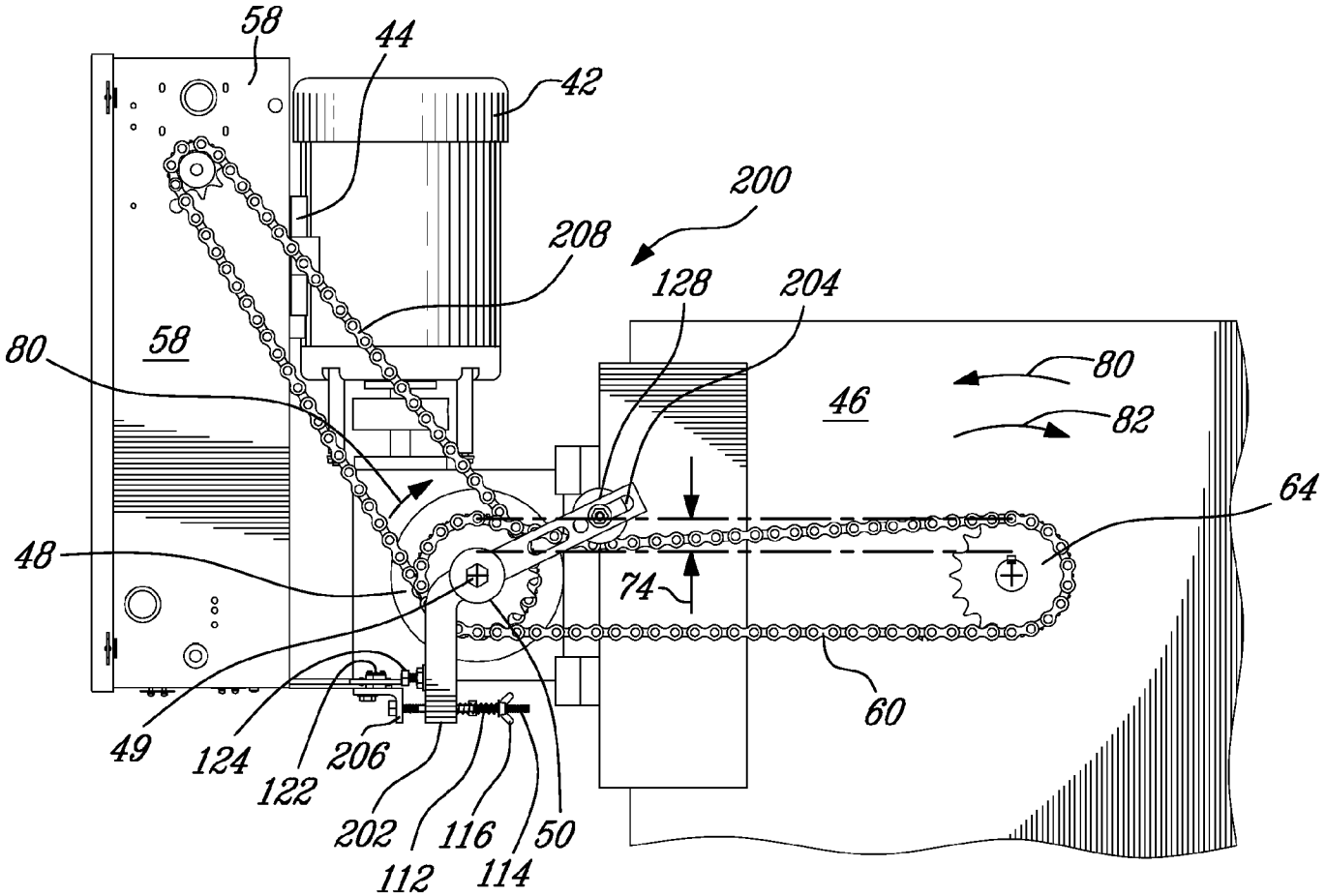
FIG. 12 is a magnified perspective view of the assisted garage door opening mechanism of FIG. 10 in a non-actuated state.
Figure 13:
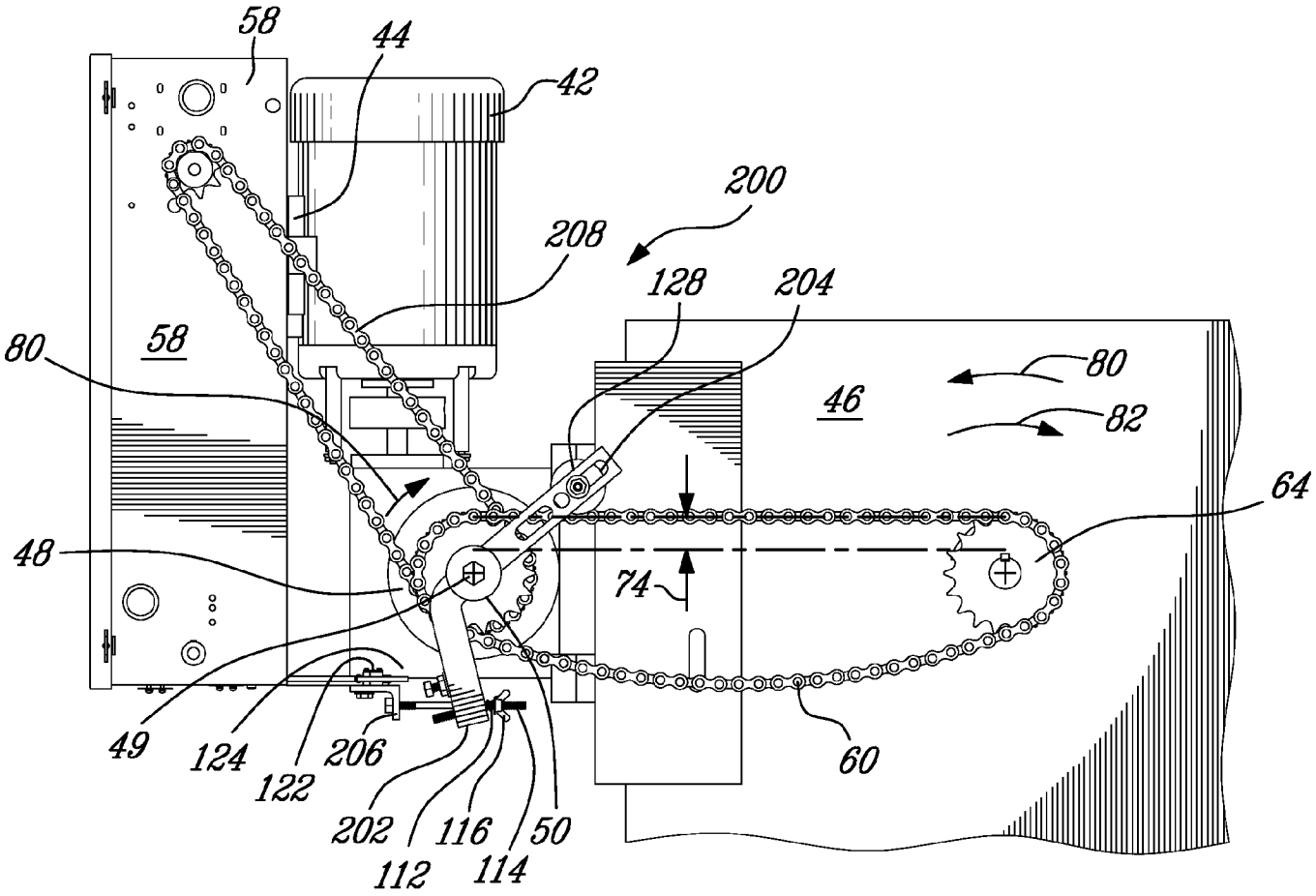
FIG. 13 is an elevational view taken from the right side of the isolated assisted garage door mechanism of FIG. 10 in an actuated state.
Figure 14:
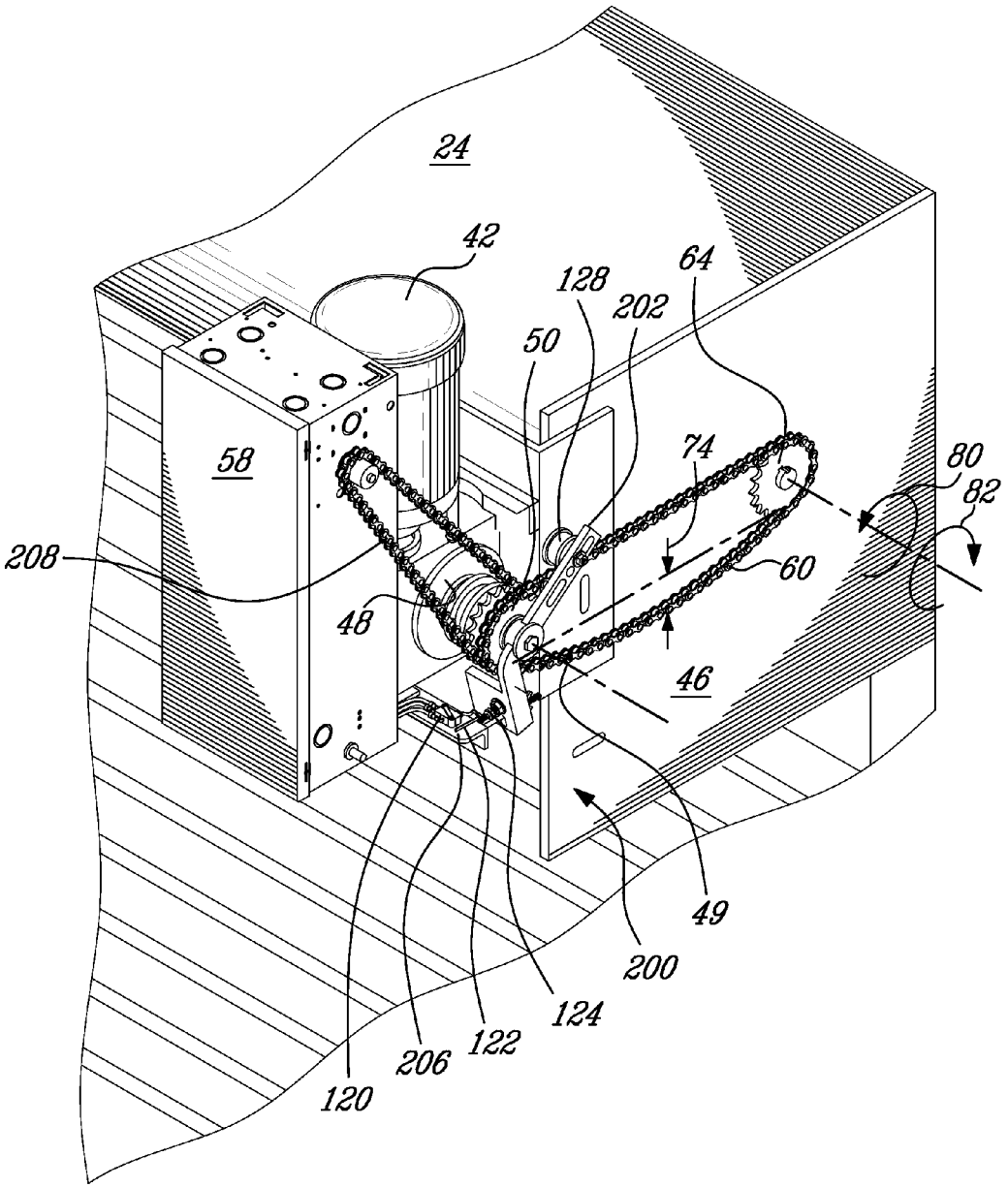
FIG. 14 is a magnified perspective view of a second embodiment of a garage door with an assisted garage door opening mechanism in an actuated state.

Another embodiment is illustrated in FIGS. 10 through 14. This embodiment is different from the previous embodiment because a lever 202 provides the actuation of the sensor 120. The garage door opening mechanism 40 is located on the other side of the garage door assembly 10 and includes an additional intervening chain 208 is disposed between the power unit 42 and the sprocket 50. Similarly with the previous embodiment, the actuation of the sensor 120 is provided when the door is moved upward to open the garage door 12. FIGS. 10 through 12 depict the lever sensor mechanism 200 in a non actuated state while FIGS. 13 and 14 depict the lever sensor mechanism 200 in an actuated state.

In this embodiment the increased tension in the endless transmission drive 60 will actuate the lever sensor mechanism 200 when the door is opened with resistance.

The lever sensor mechanism 200 is used to determine the amount of slack 74 in the endless transmission drive 60 to infer the resistance provided by the garage door 12 when the power unit 42 applies a movement to the garage door 12. The tension in the endless transmission drive 60 will not be significant enough to actuate the lever sensor mechanism 200 when the movement is applied by the power unit 42 to a garage door 12 that is free to move up.

As seen on FIGS. 10 through 12, the lever 202 is pivoting about the sprocket axis 49 and contacts one side of the endless transmission drive 60 via a bearing member 128. The position of the bearing member 128 on the lever 202 is adjustable along a slot 204 provided in the lever 202. This adjustment changes the length of the lever and therefore changes the amount of pressure and the contact location of the bearing member 128 on the endless transmission drive 60. The lever 202 is curved to join the sensor 120 in its illustrated position but the shape of the lever 202 could be adapted to a different layout without departing from scope of the present invention. The bearing member 128 is similar to the bearing member 128 of the direct sensor mechanism 100 described above and is used to contact the endless transmission drive 60 to determine the amount of slack 74 in the endless transmission drive 60.

The lever 202 is biased toward the endless transmission drive 60 and follows its movements notwithstanding the amount of slack 74 in the endless transmission drive 60. It is understood the lever 202 has a limited angular stroke but that angular stroke is proportional to the normally expected slack 74 in the endless transmission drive 60 in the course of normal operations.

The bearing member 128 depicted in this embodiment is a circular bearing member 128 that rotates with the linear displacement of the endless transmission drive 60. A fixed bearing member 128 made of low friction material is also encompassed by the instant application.

The sensor 120 is fixedly connected to an arbitrary structure in the neighbourhood of the other pivot 202 end. In the present situation the sensor 120 is connected to the electrical box 58 via a bracket 206. The bearing member 128 is biased toward the endless transmission drive 60 by a spring 112 applying a force on the lever 202. The spring 112 is guided by a guide member 114 fixedly fastened to the bracket 206. The preload provided by the spring 112 to the pivot 202 applies pressure on the endless transmission drive 60 providing a minimum of tension in the endless transmission drive 60 thus recuperating the slack 74 from the endless transmission drive 60. The force provided by the spring 112 can be adjusted by preloading the spring 112 with the nut 116. By increasing the spring 112 preload one will prevent the lever sensor mechanism 200 to be activated by the sole weight of a heavy garage door 12 or a garage door 12 that is simply normally difficult to open.

The movement of the pivot 202 can optionally be limited by an optional adjustable stopper (not shown) disposed on the bracket 206 and abutting the lever 202 at the end of the permitted travel. The sensor 120 is connected to the bracket 206 and is actuated by a sensor lever 122 contacting the lever 202. The threshold at which the sensor 120 will react could be tuned by changing the position of a lever contact member 124 that optionally intervenes with the sensor lever 122.

The final output drive 48 of the power unit 42 rotates in two directions. A first direction, as indicated by arrow 82, moves the garage door 12 upward. Conversely, rotation of the final output drive 48 in the opposite direction, indicated by arrow 80, moves the garage door 12 upward. In the event the garage door 12 is encountering difficulties on its travel up, the power unit 42 will apply significantly more tension in the endless transmission drive 60 then it normally has to. The lever sensor mechanism 200, that is building a predetermined force on the endless transmission drive 60, is positioned by the slack 74 in the endless transmission drive 60. Referring now to FIGS. 13 and 14, when tension increases in the endless transmission drive 60, because the garage door 12 cannot move upward as easily as it is supposed to normally do, the lever 202 is pushed by the endless transmission drive 60 and the sensor 102 is activated if the angular stroke is significant enough to move beyond the sensor 102 threshold. It has to be noted that, in the present embodiment, actuation of the sensor 102 happens when the sensor 102 is at rest and the sensor lever 122 is not pushed.

When the sensor 102 threshold is reached the sensor 102 cuts the power going to the power unit in the case the sensor 102 is used on a power circuit. In contrast, the sensor 102 sends a signal or opens the electrical circuit if the sensor 102 is applied to a control electrical circuit. The control electrical circuit will act on the power electrical circuit in the latter case. In both situations the power unit 42 will stop opening the garage door 12.

Additionally, the lever sensor mechanism 200 could be used with a clutch (not shown) or another kind of power dissipation means preventing movement of the garage door 12.

Lever Sensor Mechanism—Door Moving Downward

Figure 15:
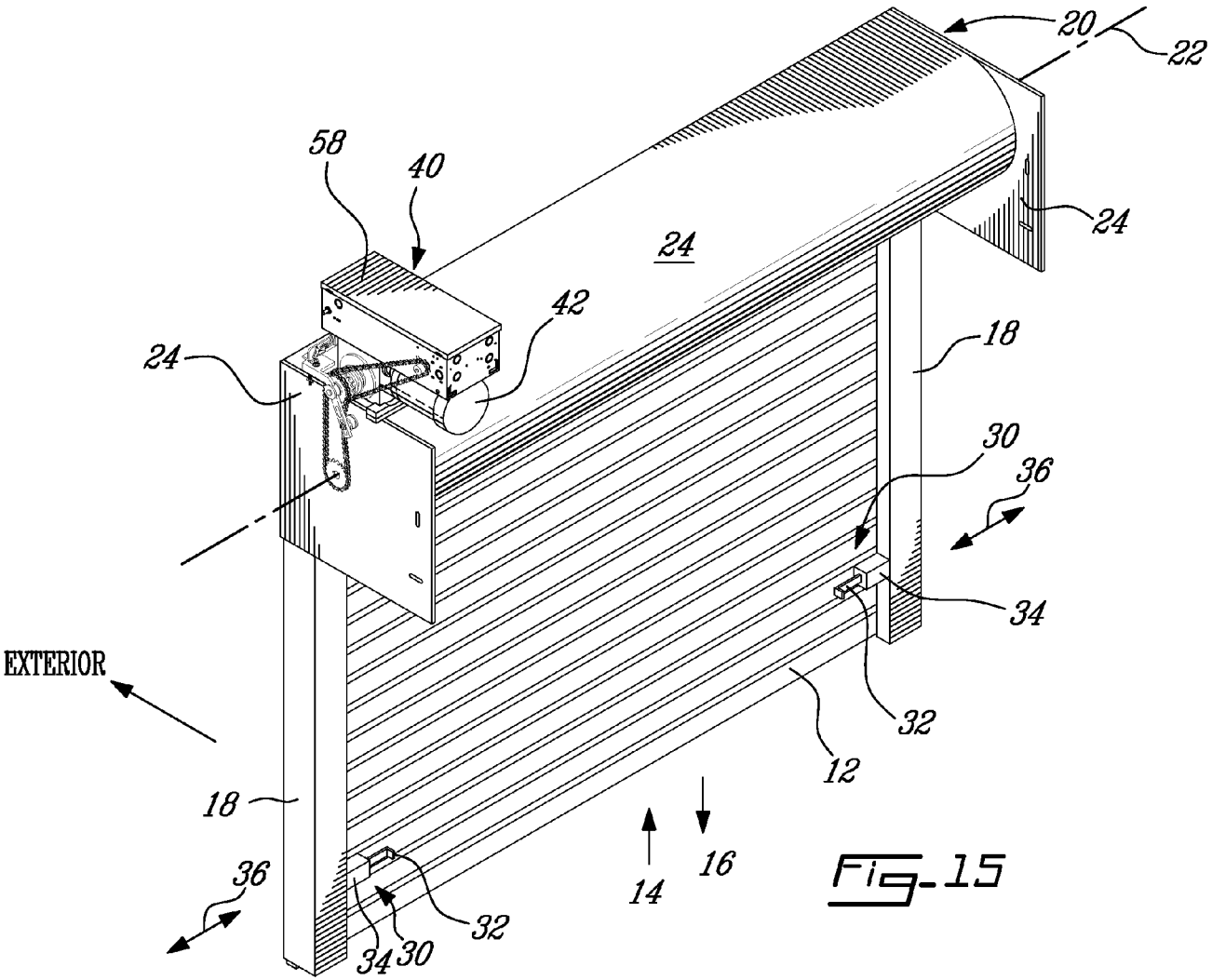
FIG. 15 is a perspective view of a third embodiment of a garage door with an assisted garage door opening mechanism in a non-actuated state.
Figure 16:
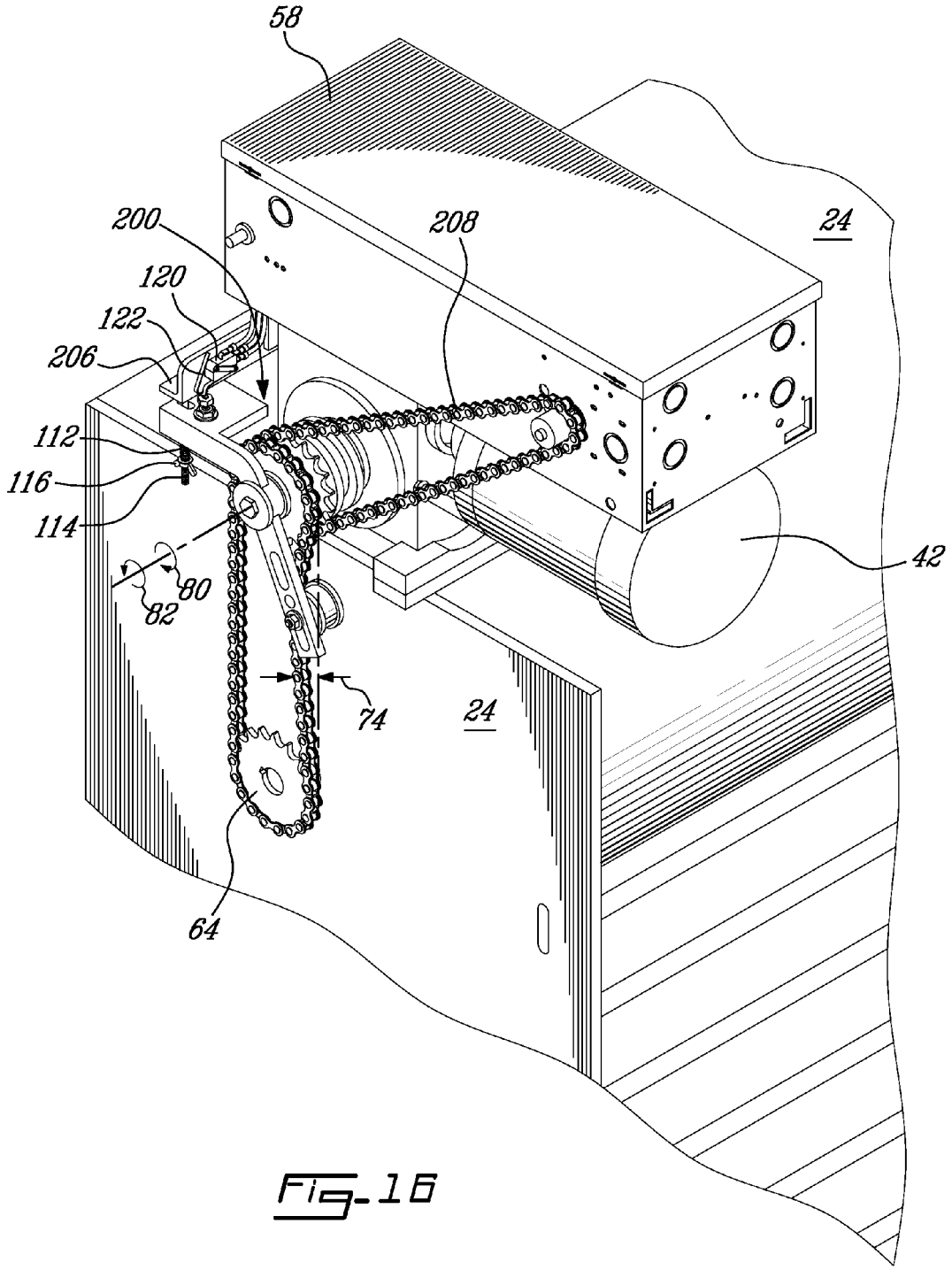
FIG. 16 is an elevational view of the assisted garage door opening mechanism of FIG. 15 taken from the left side.
Figure 17:
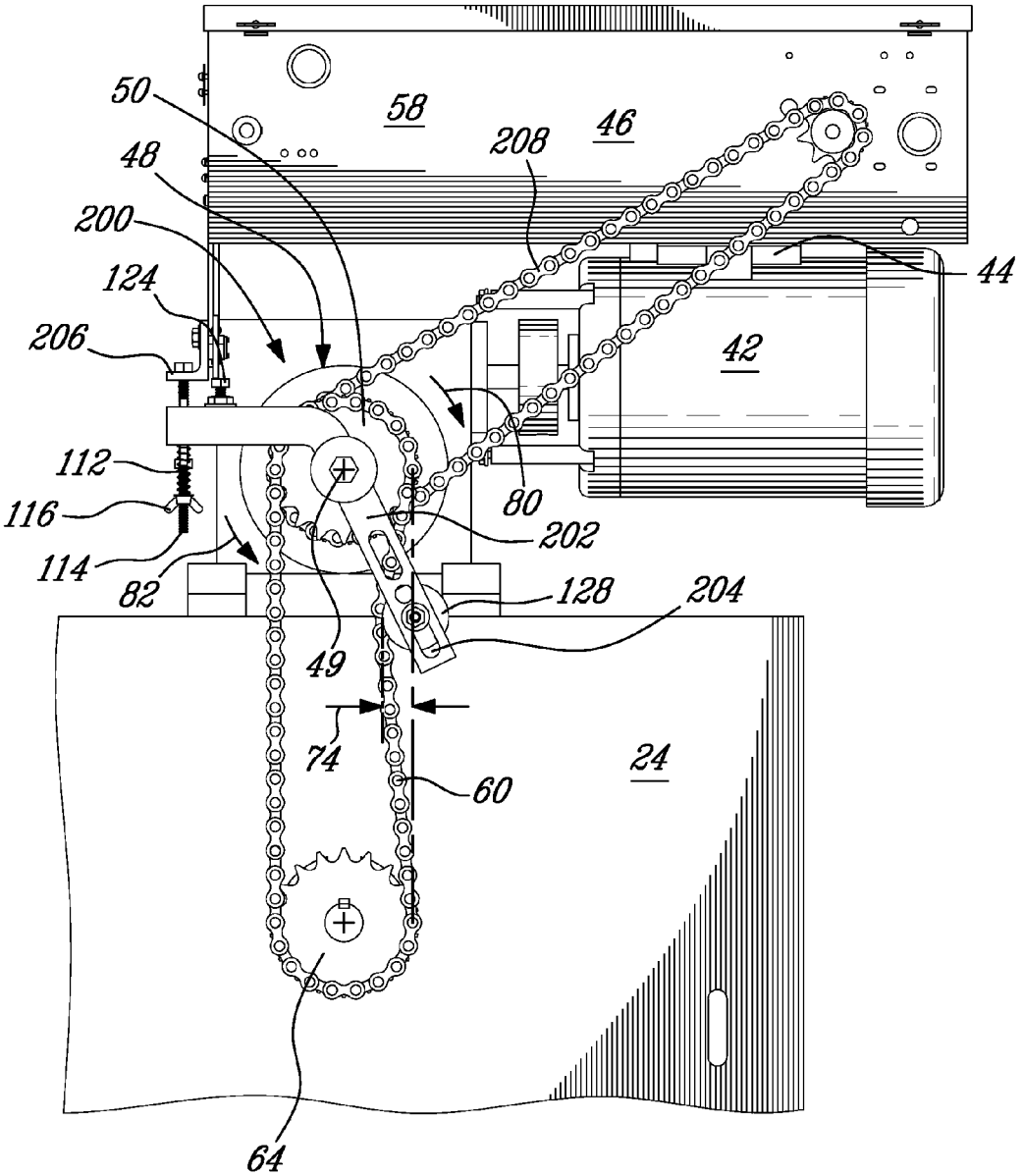
FIG. 17 is a magnified perspective view taken of the assisted garage door mechanism of FIG. 15.
Figure 18:
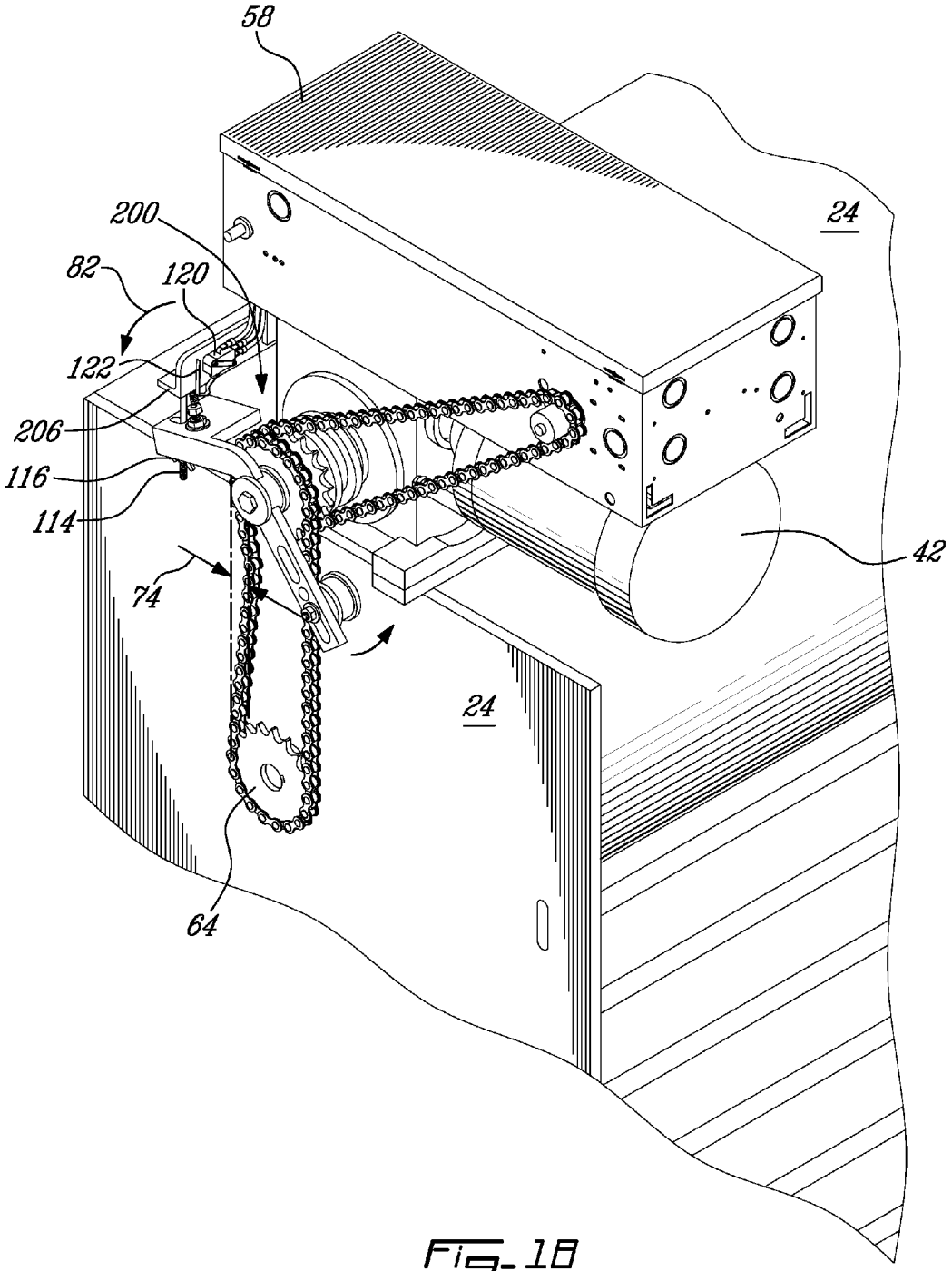
FIG. 18 is an elevational view taken from the left side of the isolated assisted garage door mechanism of FIG. 15 in an actuated state.
Figure 19:
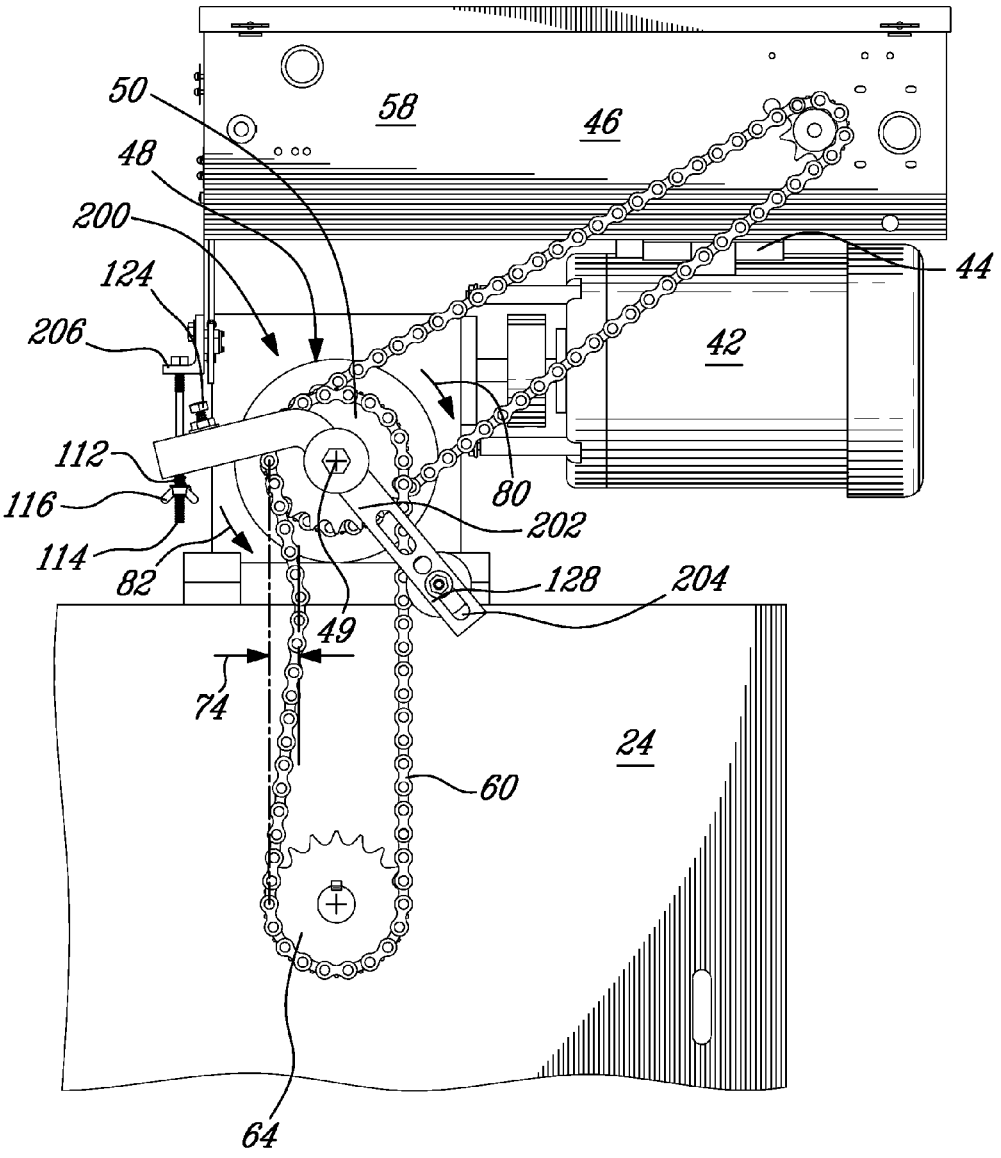
FIG. 19 is a magnified perspective view of the assisted garage door mechanism of FIG. 15 in an actuated state.

Another alternate embodiment is illustrated in FIGS. 15 through 19. This embodiment differs from the first two embodiments because the sensor 120 is actuated when the door is moved downward to close the garage door 12. FIGS. 15 through 17 depict the lever sensor mechanism 200 in a non actuated state while FIGS. 18 and 19 depict the lever sensor mechanism 200 in an actuated state.

In this embodiment the increased tension in the endless transmission drive 60 will actuate the lever sensor mechanism 200 when the door is lowered with resistance. This is an additional safety feature in case the garage door 12 encounters a restriction when moved down.

Here again the lever sensor mechanism 200 is used to determine the amount of slack 74 in the endless transmission drive 60 to infer the resistance provided by the garage door 12 when the power unit 42 applies a movement to the garage door 12. The tension in the endless transmission drive 60 will not be significant enough to actuate the direct sensor mechanism 100 if the movement is applied by the power unit 42 to a garage door 12 that is free to move down.

As seen on FIGS. 10 through 12, the lever 202 is pivoting about the sprocket axis 49 and contacts one side of the endless transmission drive 60 via a bearing member 128. The position of the bearing member 128 on the lever 202 is adjustable along a slot 204 provided in the lever 202. This adjustment changes the length of the lever and therefore changes the amount of pressure and the contact location of the bearing member 128 on the endless transmission drive 60. The lever 202 is curved to join the sensor 120 in its illustrated position but the shape of the lever 202 could be adapted to a different layout without departing from scope of the present invention. The bearing member 128 is similar to the bearing member 128 of the direct sensor mechanism 100 described above and is used to contact the endless transmission drive 60 to determine the amount of slack 74 in the endless transmission drive 60.

The lever 202 is biased toward the endless transmission drive 60 and follows its movements notwithstanding the amount of slack 74 in the endless transmission drive 60. It is understood the lever 202 has a limited angular stroke but that angular stroke is proportional to the normally expected slack 74 in the endless transmission drive 60.

The bearing member 128 depicted in this embodiment is a circular bearing member 128 that rotates with the linear displacement of the endless transmission drive 60. A fixed bearing member 128 made of low friction material is also encompassed by the instant application.

The sensor 120 is fixedly connected to an arbitrary structure in the neighbourhood of the other pivot 202 end. In the present situation the sensor 120 is connected to the electrical box 58 via a bracket 206. The bearing member 128 is biased toward the endless transmission drive 60 by a spring 112 applying a force on the lever 202. The spring 112 is guided by a guide member 114 fixedly fastened to the bracket 206. The preload provided by the spring 112 to the pivot 202 applies a force on the endless transmission drive 60 providing a minimum of tension in the endless transmission drive 60 thus recuperating the slack 74 from the endless transmission drive 60. The force provided by the spring 112 can be adjusted by preloading the spring 112 with the nut 116. By increasing the spring 112 preload one will prevent the lever sensor mechanism 200 to be activated by the sole weight of a heavy garage door 12 or a garage door 12 that is simply normally difficult to close.

The movement of the pivot 202 can optionally be limited by an adjustable stopper (not shown) disposed on the bracket 206 and abutting the lever 202 at the end of the permitted travel. The sensor 120 is connected to the bracket 206 and is actuated by a sensor lever 122 contacting the lever 202. The threshold at which the sensor 120 will react could be tuned by changing the position of a lever contact member 124 that optionally intervenes with the sensor lever 122.

The final output drive 48 of the power unit 42 rotates in two directions. A first direction, as indicated by arrow 80, moves the garage door 12 upward. Conversely, rotation of the final output drive 48 in the opposite direction, indicated by arrow 82, moves the garage door 12 upward. In the event the garage door 12 is encountering an object on its travel down the power unit 42 will apply significantly more tension in the endless transmission drive 60 that it normally has to. The lever sensor mechanism 200, that is building a predetermined amount of tension on the endless transmission drive 60, is positioned by the slack 74 in the endless transmission drive 60. Referring now to FIGS. 13 and 14, when tension increases in the endless transmission drive 60, because the garage door 12 cannot move downward as easily as it is supposed to normally do, the lever 202 is pushed by the endless transmission drive 60 and the sensor 102 is activated if the stroke 74 is significant enough to move beyond the sensor 102 threshold. It has to be noted that in the present embodiment actuation of the sensor 102 happens when the sensor 102 is at rest and the sensor lever 122 is not pushed.

When the sensor 102 threshold is reached the sensor 102 cuts the power going to the power unit in the case the sensor 102 is used on a power circuit. Conversely, the sensor 102 sends a signal or opens the electrical circuit if the sensor 102 is applied to a control electrical circuit. The control electrical circuit will act on the power electrical circuit in the latter case. In both situations the power unit 42 will stop closing the garage door 12.

Additionally, the lever sensor mechanism 200 could be used with a clutch (not shown) or another kind of power dissipation means preventing movement of the garage door 12.

Although the invention has been described with reference to certain specific embodiments, various modifications and improvements thereof will be apparent to those skilled in the art without departing from the spirit and scope of the invention as outlined in the claims appended hereto. The entire disclosures of all references recited above are incorporated herein by reference.

I claim:

1. A garage door opening module comprising:

a power unit having a rotatable output drive, the power unit being adapted to move a garage door when the power unit is used in conjunction with the garage door;

an endless transmission drive adapted to transfer movement from the rotatable output drive to a door drive;

a locking mechanism adapted to manually lock the garage door in a closed position, the locking mechanism causing an increased tension in the endless transmission drive when the power unit moves the garage door while the locking mechanism manually locks the garage door in the closed position; and a sensor mechanism positioned along the endless transmission drive and adapted to sense a transmission drive slack, the sensor being in a non-actuated state when the tension of the endless transmission drive is below a transmission drive slack displacement threshold and being actuated when the tension in the endless transmission drive is increased to reach the transmission drive slack displacement threshold due to the power unit moving the garage door while the locking mechanism manually locks the garage door in the closed position, the sensor mechanism stopping a movement of the door drive when in the actuated state.

2. The garage door opening module of claim 1, wherein the endless transmission drive comprises a first transmission drive segment and a second transmission drive segment, the first transmission drive segment and the second transmission drive segment being disposed between the output drive and the door drive, the first transmission drive segment being in tension when the rotatable output drive rotates in a first direction and the second transmission drive segment being in tension when the rotatable output drive rotates in a second direction, the sensor mechanism being positioned along one of the transmission drive segments.

3. The garage door opening module of claim 2, wherein the sensor mechanism is held in position with a bracket providing a sensor adjustment mechanism to change the position of the sensor mechanism about one of the transmission drive segments.

4. The garage door opening module of claim 2, wherein the sensor mechanism is biased toward one of the transmission drive segments and acts as a tensioner to the transmission drive.

5. The garage door opening module of claim 4, wherein the sensor mechanism is adjustably biased to adjust a tension applied on the transmission drive.

6. The garage door opening module of claim 2, wherein the sensor mechanism comprises a bearing member adapted to contact the transmission drive.

7. The garage door opening module of claim 2, wherein, when the garage door opening module is used in conjunction with a garage door, the rotatable output drive rotates in the first direction when the power unit moves the garage door upward and the rotatable output drive rotates in the second direction when the power unit moves the garage door downward, the sensor sensing the transmission drive slack of the first transmission drive segment.

8. The garage door opening module of claim 7, wherein the transmission drive slack displacement threshold is measured orthogonally from the first transmission drive segment and is less than 10 millimeters.

9. The garage door opening module of claim 2, wherein, when the garage door opening unit is used in conjunction with a garage door, the rotatable output drive rotates in the first direction when the power unit moves the garage door upward and the rotatable output drive rotates in the second direction when the power unit moves the garage door downward, the sensor sensing the transmission drive slack on the second transmission drive segment.

10. The garage door opening module of claim 9, wherein the transmission drive slack displacement threshold is measured orthogonally from the first transmission drive segment and is less than 10 millimeters.

11. A method for actuating a garage door, with a garage door opening module comprising:

a power unit having a rotatable output drive, the power unit being adapted to move a garage door when the power unit is used in conjunction with the garage door;

an endless transmission drive adapted to transfer movement from the rotatable output drive to a door drive;

a locking mechanism adapted to manually lock the garage door in a closed position, the locking mechanism causing an increased tension in the endless transmission drive when the power unit moves the garage door while the locking mechanism manually locks the garage door in the closed position; and a sensor mechanism positioned along the endless transmission drive and adapted to sense a transmission drive slack, the sensor being in a non-actuated state when the tension of the endless transmission drive is below a transmission drive slack displacement threshold and being actuated when the tension in the endless transmission drive is increased to reach the transmission drive slack displacement threshold due to the power unit moving the garage door while the locking mechanism manually locks the garage door in the closed position, the sensor mechanism stopping a movement of the door drive when in the actuated state, the method comprising: powering the power unit; sensing the transmission drive slack in the endless transmission drive; and sending a signal adapted to stop moving the garage door when in the actuated state.

12. The method for actuating a garage door of claim 11, wherein the endless transmission drive is a chain drive and wherein the predetermined slack threshold is measured orthogonally from the endless transmission drive and is less than 10 millimeters.

13. The method for actuating a garage door of claim 11, comprising biasing the sensor mechanism toward the endless transmission drive and adapted to act as a tensioner to the transmission drive.

14. The method for actuating a garage door of claim 13, wherein the sensor mechanism is actuated by an amount of the slack in the endless transmission drive and actuates a sensor adapted to change a state of an electrical circuit material to powering the power unit.

15. The garage door opening module of claim 1, wherein the sensor mechanism is adapted to stop the movement of the door drive upon detection of a sufficient increase in a tension of the endless transmission drive resulting from resistance to a movement of the garage door.

16. The garage door opening module of claim 1, wherein the sensor mechanism comprises a sensor frame biased towards the endless transmission drive.

17. The garage door opening module of claim 16, wherein the sensor frame applies pressure on the endless transmission drive through a bearing member, the bearing member providing tension in the endless transmission drive while recuperating the slack in the endless transmission drive.

18. The garage door opening module of claim 1, wherein the sensor mechanism stops the movement of the door drive by cutting power input of the power unit.

19. The garage door opening module of claim 1, wherein the sensor mechanism stops the movement of the door drive by sending a signal to a control electrical circuit.

20. A garage door opening module comprising:

a power unit having a rotatable output drive, the power unit being adapted to move a garage door when the power unit is used in conjunction with the garage door;

an endless transmission drive adapted to transfer movement from the rotatable output drive to a door drive;

a locking mechanism adapted to manually lock the garage door in a closed position, the locking mechanism causing an increased tension in the endless transmission drive when the power unit moves the garage door while the locking mechanism manually locks the garage door in the closed position; and a sensor mechanism positioned along the endless transmission drive and adapted to sense a transmission drive slack, the sensor mechanism being configured to stop a movement of the door drive upon detection of a sufficient increase in a tension of the endless transmission drive resulting from the power unit moving the garage door while the locking mechanism manually locks the garage door in the closed position.

* * * * *